US006512906B2

(12) United States Patent
Gack

(10) Patent No.: US 6,512,906 B2
(45) Date of Patent: Jan. 28, 2003

(54) MECHANISM FOR FASTENING THIN COROTRON WIRES AND METHOD FOR GENERATING A COROTRON DISCHARGE

(75) Inventor: Hartmut Gack, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/901,741

(22) Filed: Jul. 10, 2001

(65) Prior Publication Data

US 2002/0018669 A1 Feb. 14, 2002

(30) Foreign Application Priority Data

Aug. 1, 2000 (DE) ..... 100 37 466

(51) Int. Cl.[7] ..... G03G 15/02; H01T 19/00

(52) U.S. Cl. ..... 399/170; 174/74 R; 250/324; 361/229; 439/868; 439/891

(58) Field of Search ..... 399/170, 171, 399/172; 361/229; 250/324, 325, 326; 29/857, 862; 174/74 R, 74 A, 87; 439/868, 891, 930, 805

(56) References Cited

U.S. PATENT DOCUMENTS 4,258,258 A 3/1981 Laing et al.
4,442,356 A 4/1984 Ludwick et al.
5,358,165 A 10/1994 Andoh
5,449,906 A 9/1995 Osbourne
5,627,376 A 5/1997 Jaisinghani et al.
6,303,933 B1 * 10/2001 Dickhoff ..... 250/324

FOREIGN PATENT DOCUMENTS

DE 37 17 273 C2 12/1987
DE 40 20 339 A1 1/1991
JP 10-97120 * 4/1998

* cited by examiner

*Primary Examiner*—Joan Pendegrass
(74) *Attorney, Agent, or Firm*—Schiff Hardin & Waite

(57) ABSTRACT

A mechanism and a method for generating a corona discharge by a wire-shaped corona discharge electrode provides that the corona discharge electrode is stretched between two end blocks that respectively contain a space for the acceptance of a respective electrode holder insert. The electrode holder insert has a rotational-symmetrical electrode receptacle element with an axially parallel electrode receptacle channel in the generated surface as well as a further electrode receptacle channel in an end face, the further channel adjoining the axially parallel channel and residing perpendicularly thereon, and also has an annular cap element that, proceeding from the end face containing the further electrode receptacle channel, can be pressed onto the electrode receptacle element with the corona discharge electrode guided in the electrode receptacle channels.

18 Claims, 3 Drawing Sheets

MECHANISM FOR FASTENING THIN COROTRON WIRES AND METHOD FOR GENERATING A COROTRON DISCHARGE

BACKGROUND OF THE INVENTION

1. Field of the Invention

The present invention is directed to a mechanism and to a method for generating a corotron discharge in electrophotographic devices by a wire-shaped corona discharge electrode.

2. Description of the Related Art

U.S. Pat. No. 4,258,258 discloses a device for generating a corotron discharge wherein a wire-shaped corona discharge electrode, which is also referred to as a corotron, is stretched between two end blocks. The end blocks each have a space through which the corona discharge electrode is conducted. At each end, the corona discharge electrode is held in a electrically non-conductive insert and is inserted with these inserts into the spaces in the end blocks.

The fundamental structure of the inserts is a cylindrical element with an inside bore within which the corona discharge electrode is guided and held at its ends. The holder, for example, can be fashioned such that the corona discharge electrode comprises a spherical thickened portion at one end that is seated on the inside bore of the appertaining insert. At the other end, the corona discharge electrode can be seated in a plug pin for an electrical plug-type connector that is provided in the appertaining insert. Another possibility would be to hold the corona discharge electrode with electrically conductive connector screws in the inserts.

Finally, it is also known—but not disclosed in the above identified United States Patent—to guide the corona discharge electrode by means of metallic terminal elements provided with small inside bores and to fix it therein by pinching.

Given these known possibilities of fastening a wire-shaped corona discharge electrode, which have inside bores for passing the electrode through, basic problems derive from the wire thickness, which lies on the order of magnitude of 1/10 mm in practice.

First, the diameters of the inside bores in the inserts of the type disclosed by the above United States Patent must be correspondingly small, which is involved in terms of manufacturing technology and therefore costly. An involved and, thus, costly manufacture runs counter to an optimally beneficial mass production.

Second, the threading of such thin electrode wires in bores with a correspondingly small diameter is also inherently problematical in view of preventing damage to the electron wire. This is additionally aggravated in that the cutting of wire sections having a suitable length for a corona discharge device produces burrs at the parting locations—the wire ends—that also make the threading more difficult. All of this opposes a desired automation of the electrode installation or at least makes it more difficult.

A fastening of wire-shaped corona discharge electrodes by pinching in metallic terminal elements is also disadvantageous both in view of the manufacture of the terminal elements with correspondingly small inside bores, of the threading of the electrode wire into the terminal elements as well as the undamaged quality thereof.

The aforementioned problems likewise occur given devices disclosed by U.S. Pat. No. 5,449,906 that fundamentally correspond to the devices of the initially cited U.S. Pat. No. 4,258,258.

What is thereby also critical is that the wire-shaped corona discharge electrode is also fastened in a stretched condition such that, in a electrophotographic device, it proceeds exactly parallel to an image acceptance element—a photoconductor element—of the device, this being of great significance for the image quality.

SUMMARY OF THE INVENTION

The present invention is based on the object of providing a mechanism and a method with which a largely automated mounting of wire-shaped corona discharge electrodes is possible while assuring that the electrodes are not damaged.

This object is achieved in a mechanism for generating a corona discharge in electrophotographic devices by means of a wire-shaped corona discharge electrode, whereby the corona discharge electrode is stretched between two end blocks, the end blocks respectively contain a space for the acceptance of a respective electrode holder insert, the electrode holder insert contains a rotationally symmetrical electrode receptacle element with an axially parallel electrode receptacle channel in the generated surface as well as a further electrode receptacle channel in an end face, the further channel adjoining the axially parallel channel and residing perpendicularly thereon, and whereby the electrode holder insert has a cap element that, proceeding from the end face containing the further electrode receptacle channel, can be pressed onto the electrode receptacle element with the corona discharge electrode guided in the electrode receptacle channels.

Further developments of the invention are provided by the electrode receptacle channels being fashioned V-shaped. The floor of the channel of the electrode receptacle channel may be fashioned round, the curvature being matched to the diameter of the wire-shaped corona discharge electrode, the floor of the channel lies centrally relative to a diameter of the circular-cylindrical part having the larger diameter, and the further electrode receptacle channel lies in the extension of the electrode receptacle channel. Identically fashioned electrode receptacle elements may be provided at the ends of the corona discharge wire. In a preferred embodiment, the electrode receptacle element comprises a circular-cylindrical part and a conical part having an overall diameter that is smaller compared to the circular-cylindrical part. The cap element may include an inside cone matched to the conic frustum-shaped part of the electrode receptacle element. In one development, the cap element is fashioned as part of a plug-type connector. Specifically, the cap element has a length suitable for an electrical plug-type connector.

In one variation, the electrode receptacle element is manufactured of plastic. Alternatively, the electrode receptacle element is manufactured of a plastic with a fiberglass or carbon fill. A preferred aspect provides that the electrode receptacle element is fashioned of polyether amide. As a further alternative, the electrode receptacle element is manufactured of a metal. For example, aluminum is employed as metal. A softer material compared to the material of the corona discharge electrode may be employed for the cap element. Another feature provides that a metal is employed as material for the cap element, for example, aluminum is employed as the metal.

In another embodiment, the invention provides a mechanism for fastening a wire-shaped corona discharge electrode by means of an electrode holder, whereby the electrode holder comprises an electrode receptacle element with an axially parallel electrode receptacle channel in the generated surface as well as a further electrode receptacle channel in an end face, the further channel adjoining the axially parallel channel, and whereby the electrode holder has an annular cap element that, proceeding from the end face containing the further electrode receptacle channel, can be pressed onto the electrode receptacle element with the corona discharge electrode guided in the electrode receptacle channels.

A method for generating a corona discharge is provided, wherein the method for fastening a wire-shaped corona discharge electrode by means of an electrode holder, includes the following features:

a) placing the corona discharge electrode into an electrode receptacle element with an axially parallel electrode receptacle channel in the generated surface as well as a further electrode receptacle channel in an end face, the further channel adjoining the axially parallel channel, b) pressing an annular cap element onto the electrode receptacle element and, thus, fixing the corona discharge electrode guided in the electrode receptacle channel can be pressed on.

The method of a further embodiment includes a method for generating a corona discharge in electrophotographic devices by means of a wire-shaped corona discharge electrode, whereby the corona discharge electrode is stretched between two end blocks, the corona discharge electrode is clamped in electrode holder inserts that have a rotationally symmetrical electrode receptacle element with an axially parallel electrode receptacle channel in the generated surface as well as a further electrode receptacle channel in an end face, the further channel adjoining the axially parallel channel and residing perpendicularly thereon, the corona discharge electrode is placed into the electrode receptacle channels of the electrode receptacle element and is conducted around this, and the annular cap element, proceeding from the end face containing the further electrode receptacle channel, is pressed onto the electrode receptacle element with the corona discharge electrode guided therein.

BRIEF DESCRIPTION OF THE DRAWINGS

The invention is explained in greater detail below on the basis of exemplary embodiments according to the Figures of the drawing.

DETAILED DESCRIPTION OF THE PREFERRED EMBODIMENTS

Figure 1:
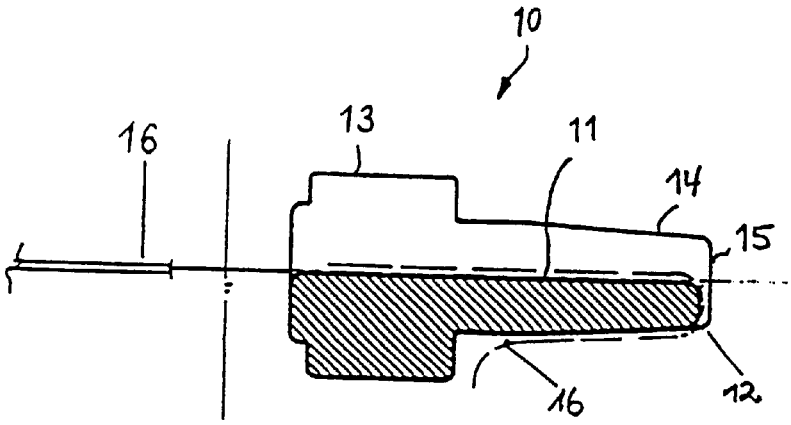
FIG. 1 is a partially cut side view of an electrode receptacle element of an electrode holder insert.
Figure 2:
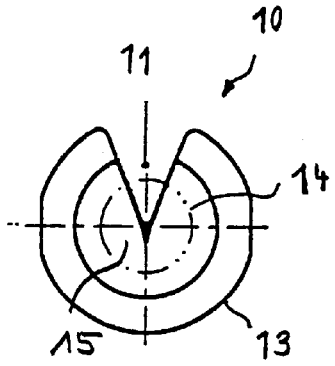
FIG. 2 is a plan view onto an end face of the electrode receptacle element seen from the left side in FIG. 1.
Figure 3:
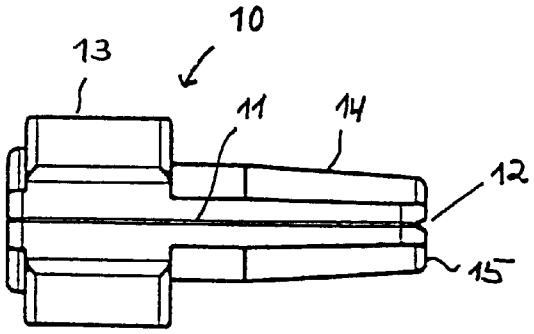
FIG. 3 is a plan view of the electrode receptacle element according to FIG. 1.

FIGS. 1 through 3 show an exemplary embodiment of an electrode receptacle element 10. This electrode receptacle element 10 is composed of a circular-cylindrical part 13 and a tapering conic frustum-shaped part 14 adjoining thereto in an axial direction and having a diameter that is smaller overall compared to the circular-cylindrical part 13.

A first V-shaped electrode receptacle channel 11 is provided in the electrode receptacle element formed by the circular-cylindrical part 13 and the conical part 14, and a second V-shaped channel 12 is provided in an end face 15 of the conic frustum-shaped part 14, the second channel 12 residing perpendicular to the first electrode acceptance channel 11 and, thus, to the axis of the electrode holder insert 10 and 20. The floor of the channel of these two electrode receptacle channels 11, 12 lies centrally on a diameter of the electrode receptacle element 10. The floor of the channel of the electrode receptacle channel 11 is thereby rounded (not explicitly shown in FIG. 2) and corresponds to the wire diameter of the corona discharge electrode 16 and lies centrally relative to the outside diameter of the circular-cylindrical part 13, whereby the electrode receptacle channel 12 lies in the end face 15 in the extension of the electrode receptacle channel 11.

A wire-shaped corona discharge electrode 16 is placed into the electrode receptacle channels 11 and 12 and is conducted around the conic frustum-shaped part 14, as schematically shown in FIG. 1.

Figure 4:
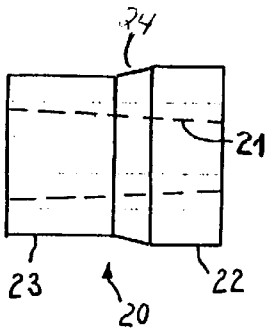
FIG. 4 is a side view of a cap element of the electrode holder insert that can be put in place onto the electrode receptacle element according to FIGS. 1 through 3.

FIG. 4 shows an exemplary embodiment of an annular cap element 20 that can be placed onto the electrode receptacle element 10. This cap element 20 has a circular-cylindrical part 22 whose diameter is equal to the diameter of the circular-cylindrical part 13 of the electrode receptacle element 10, and also has a further circular-cylindrical part 23 having a smaller diameter compared to the diameter of the circular-cylindrical part 22. The circular-cylindrical parts 22 and 23 merge into one another via a part 24 that tapers conic frustum-shaped.

The cap element 20 contains an inside cone 21 adapted in shape to the conic frustum-shaped part 14 of the electrode receptacle element 10. When, with a to corona discharge electrode 16 inserted (see FIG. 1), the cap element is pressed onto the conic frustum-shaped part 14 proceeding from the side of the circular-cylindrical part 23, then the corona discharge electrode 16 is fixed in the electrode holder insert formed by the two elements 10 and 20. The insertion procedure of the wire-shaped corona discharge electrode 16 into the electrode receptacle channels 11 and 12 and conducting this around the conic frustum-shaped part 14 is considerably simpler compared to a threading procedure given known mechanisms of the type initially discussed and is considerably safer in view of avoiding damage. Due to the different diameters of their parts 13 and 14 or, respectively, 22 and 23, over and above this, the electrode receptacle element 10 and the cap element 20 are also especially suited for an automatic assembly, since the parts 14 or, respectively, 23 having a smaller diameter weight less than the parts 13 or, respectively, 22 having a larger diameter, and, thus, a prioritized alignment of the elements 10 and 20 is assured, for example in shakers.

As described above, the parts 13 and 22 of the electrode receptacle element 10 or, respectively, of the cap element 20 have the same diameter and extend over only a part of these elements and therefore yield a predetermined guidance length. It is therefore assured that the electrode holder insert formed by assembling the elements 10 and 20 can be introduced into an inside bore of an end block with less susceptibility to being tilted. Over and above this, an exact, parallel alignment of the wire-shaped corona discharge electrode 16 relative to a photoconductor element of an electrophotographic device is assured. The mounting of an electrode holder insert 10 and 20 in an end block will be explained below with reference to FIG. 5.

Electrode receptacle elements can be composed of non-conductive or conductive material, for example a filled plastic or a plastic with glass or carbon fibers. For example, polyether imide (PEI) comes into consideration as the plastic. This makes a simple manufacture as a molded part possible, which is beneficial for mass production. However, electrode receptacle elements can also be manufactured of a metal, for example aluminum.

Cap elements are preferably composed of a material that is softer compared to the material of the corona discharge electrodes. As a result thereof, the seat of the pressed-on cap elements and, thus, the fixing of the electrode wire become even surer. A metal such as, for example, aluminum comes into consideration as the material for the cap elements.

An assembly method of an electrode holder insert 10 and 20 with a fixed, wire-shaped corona discharge electrode 16 is explained below on the basis of FIG. 5. In the exploded view of FIG. 5, the electrode receptacle element 10 and the cap element 20 are shown still separated. The cap element 20 with the inside cone 21 is pressed onto the conical part 14 with the wire-shaped corona discharge electrode 16 placed into the electrode receptacle channels 11 and 12.

Figure 5:
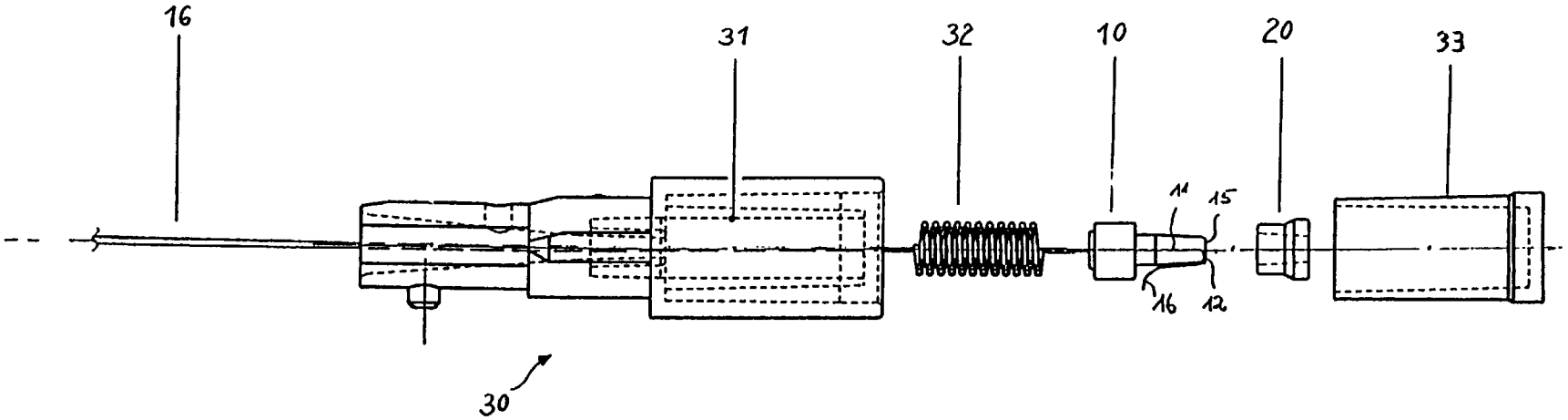
FIG. 5 is an exploded view that reveals the assembly of an end block that accepts the electrode insert.

FIG. 5 shows an end block formed of two parts 30 and 33 for the acceptance of the electrode holder insert 10 and 20. The part 30 contains, among other things, an inside bore 31 for the acceptance of a spring 32 and of the electrode holder insert 10 and 20. The wire-shaped corona discharge electrode 16 is guided from the electrode holder insert 10 and 20 by the end block part 30 and the spring 32. When the spring 32 and the electrode holder insert 10 and 20 are introduced into the inside bore 31 of the end block part 30, then the end block part 33 is pressed into the end block part 30. The electrode holder insert 10 and 20 is thus fixed in the end block 30, whereby the spring 32 keeps the wire-shaped corona discharge electrode 16 under a predetermined tension.

A further end block (see FIG. 6) corresponding to the end block 30 and 33 is provided at the other end of the wire-shaped corona discharge electrode 16 for the acceptance of the electrode holder insert at the other end of the wire-shaped corona discharge electrode 16. The part 22 of the cap element 20 can thereby have a length suitable for an electrical plug connector. The part 22 will then be correspondingly longer contrasting with the illustration of FIGS. 4 and 5, which can also be seen in FIG. 6.

Figure 6:
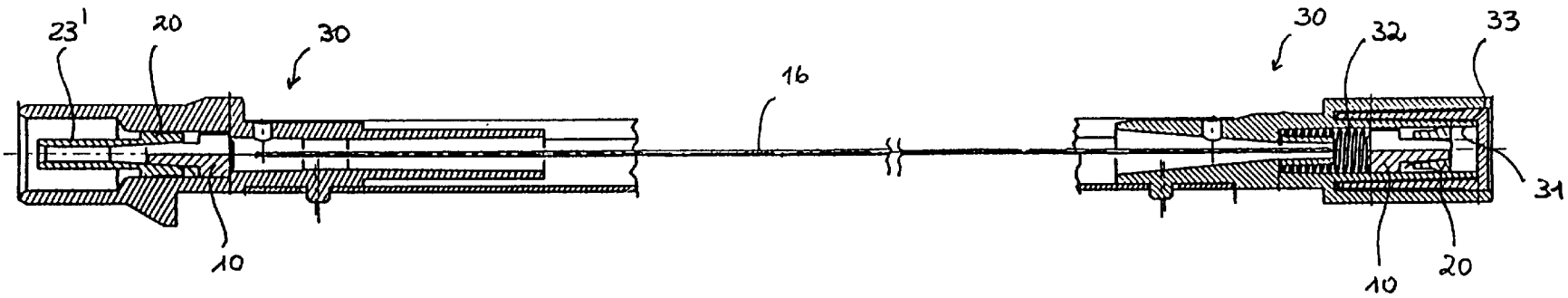
FIG. 6 is a partially cut side view of a mechanism with electrode holder inserts mounted in end blocks.

FIG. 6, wherein parts that are the same as in FIGS. 1 through 5 are provided with the same reference characters, shows the mechanism for the mounted stretching of the corona discharge electrode 16 in its assembled condition. As seen in the right-hand end block 30 and 33, the spring 32 and the electrode holder insert 10 and 20 are inserted into the inside bore 31 of the end block part 30 in FIG. 6 and the end block part 33 has been put in place on the end block part 30. The corresponding case applies to the left part as seen in FIG. 6, whereby this is the plug side of the mechanism. It can also be seen from FIG. 6 that the circular-cylindrical part (referenced 23' therein) of the cap element 20 has a suitable length for a plug connector. A part corresponding to the end block part 33 is thereby lacking because the end block party 30 must be open at the end side in the region of the circular-cylindrical part 23' for a plug-type connector. The holding of the electrode holder insert 10 and 20 in the end block part 30 thereby ensues, for example, by axial deformation with ultrasound in the joining region between the parts 22 and 23 of the cap element 20.

The above-explained mechanism of the invention has the advantage that a wire-shaped corona discharge electrode can be placed into open V-shaped channels by being directed around the electrode receptacle element, and, thus, a threading of the electrode into small-diameter bores is not required. Holding the electrode ensues in a simple way by subsequently pressing the cap element onto the electrode receptacle element. This yields an exact centering and fixing of the position of the corona discharge electrode and, over and above this, an exact and optimum attitudinal positioning relative to a photoconductor element of an electrophotographic device. The fixing of the wire-shaped corona discharge electrode is very simple to automate. In particular, the electrode receptacle element can be composed of non-conductive material, so that manufacture is possible as, for example, a simple molded plastic part. Finally, electrode holder inserts of the inventive type can also be multiply employed both at a plug side as well as at the side of the wire end.

The above-described fastening mechanism for corona discharge electrodes is especially suited for employment in a device as disclosed in International Patent Application PCT/EP00/12045 bearing the title "Korotron mit auf Auflagem aufliegendem Halteelement, einer Anordnung mit einer Spannungsversorgungseinheit sowie Anordnung zum Austauschen eines Korotrondrahtes", which does not enjoy prior publication. This PCT application is a constituent part of the disclosure of the present application and is incorporated herein by reference.

Although other modifications and changes may be suggested by those skilled in the art, it is the intention of the inventor to embody within the patent warranted hereon all changes and modifications as reasonably and properly come within the scope of their contribution to the art.

I claim:

1. A mechanism for generating a corona discharge in a electrophotographic device, comprising:

a wire-shaped corona discharge electrode;

an electrode holder insert at each end of said wire-shaped corona discharge electrode;

two end blocks with said wire-shaped corona discharge electrode stretched therebetween, said end blocks each defining a space for accepting a respective one of said electrode holder inserts;

said electrode holder inserts each including:

a rotationally symmetrical electrode receptacle element with an axially parallel electrode receptacle channel in a generated surface as well as a further electrode receptacle channel in an end face, said further electrode receptacle channel adjoining said axially parallel channel and residing perpendicularly thereon, and a cap element pressed onto said rotationally symmetrical electrode receptacle element with said wire-shaped corona discharge electrode guided in said electrode receptacle channels proceeding from said end face containing said further electrode receptacle channel;

wherein said electrode receptacle channels are V-shaped.

2. A mechanism according to claim 1, wherein said electrode receptacle channel has a floor that is rounded, a curvature of said floor being matched to a diameter of said wire-shaped corona discharge electrode, said floor lying centrally relative to a diameter of said rotationally symmetrical electrode receptacle element, and said further electrode receptacle channel being at an extension of the electrode receptacle channel.

3. A mechanism according to claim 1, wherein said rotationally symmetrical electrode receptacle elements at each end of said wire-shaped corona discharge electrode are substantially identical to one another.

4. A mechanism according to claim 1, wherein said rotationally symmetrical electrode receptacle elements each include a circular-cylindrical part and a frusto-conical part having an overall diameter that is smaller compared to said circular-cylindrical part.

5. A mechanism according to claim 1, wherein said cap element includes an inside conical surface substantially matched to the frusto-conical part of said rotationally symmetrical electrode receptacle element.

6. A mechanism according to claim 1, wherein said cap element is part of a plug-type connector.

7. A mechanism according to claim 6, wherein said cap element has a length suitable for an electrical plug-type connector.

8. A mechanism according to claim 1, wherein said rotationally symmetrical electrode receptacle element is of plastic.

9. A mechanism according to claim 1, wherein said rotationally symmetrical electrode receptacle element is of a plastic with one of a fiberglass and a carbon filler.

10. A mechanism according to claim 1, wherein said rotationally symmetrical electrode receptacle element is of polyether amide.

11. A mechanism according to claim 1, wherein said rotationally symmetrical electrode receptacle element is of a metal.

12. A mechanism according to claim 11, wherein said metal is aluminum.

13. A mechanism according to claim 1, wherein said cap element is of a material that is softer than a material of said wire-shaped corona discharge electrode.

14. A mechanism according to claim 1, wherein said cap element is of a metal.

15. A mechanism according to claim 14, wherein said metal is aluminum.

16. A mechanism for fastening a wire-shaped corona discharge electrode, comprising:

an electrode holder including:

an electrode receptacle element with an axially parallel electrode receptacle channel in a generated surface as well as a further electrode receptacle channel in an end face, said further channel adjoining said axially parallel channel, an annular cap element pressed onto said electrode receptacle element with the wire-shaped corona discharge electrode guided in the electrode receptacle channels proceeding from an end face containing said further electrode receptacle channel;

wherein said electrode receptacle channels are V-shaped.

17. A method for fastening a wire-shaped corona discharge electrode, comprising the steps of:

placing the wire-shaped corona discharge electrode into an electrode receptacle element with an axially parallel electrode receptacle channel in a generated surface as well as a further electrode receptacle channel in an end face, the further channel adjoining said axially parallel channel;

pressing an annular cap element onto the electrode receptacle element and thereby fixing the wire-shaped corona discharge electrode guided in the electrode receptacle channel;

wherein said electrode receptacle channels are V-shaped.

18. A method for generating a corona discharge in electrophotographic devices by a wire-shaped corona discharge electrode, comprising the steps of:

stretching the wire-shaped corona discharge electrode between two end blocks;

clamping the wire-shaped corona discharge electrode in electrode holder inserts that each have a rotationally symmetrical electrode receptacle element with an axially parallel electrode receptacle channel in a generated surface as well as a further electrode receptacle channel in an end face, the further electrode receptacle channel adjoining the axially parallel electrode receptacle channel and residing perpendicularly thereon;

placing the wire-shaped corona discharge electrode into the electrode receptacle channels of the rotationally symmetrical electrode receptacle element and conducting the wire-shaped corona discharge electrode around an end of the rotationally symmetrical electrode receptacle element; and pressing an annular cap element onto the rotationally symmetrical electrode receptacle element proceeding from an end face containing the further electrode receptacle channel with the wire-shaped corona discharge electrode guided therein;

wherein said electrode receptacle channels are V-shaped.

* * * * *